US009896232B2

(12) United States Patent
Zinnen

(10) Patent No.: US 9,896,232 B2
(45) Date of Patent: Feb. 20, 2018

(54) CLEANING, POLISHING, AND RESTORING EMULSION AND METHOD OF MAKING AND PACKAGING THE EMULSION

(71) Applicant: Travis Zinnen, Virginia Beach, VA (US)

(72) Inventor: Travis Zinnen, Virginia Beach, VA (US)

( * ) Notice: Subject to any disclaimer, the term of this patent is extended or adjusted under 35 U.S.C. 154(b) by 528 days.

(21) Appl. No.: 14/534,604

(22) Filed: Jan. 28, 2015

(65) Prior Publication Data

US 2015/0128526 A1 May 14, 2015

Related U.S. Application Data

(60) Provisional application No. 61/902,185, filed on Nov. 9, 2013.

(51) Int. Cl.

| | |
|---|---|
| ***C11D 7/24*** | (2006.01) |
| ***C11D 11/00*** | (2006.01) |
| ***B65C 1/04*** | (2006.01) |
| ***C11D 7/26*** | (2006.01) |

(52) U.S. Cl.

CPC ..... *B65C 1/04* (2013.01); *C11D 7/24* (2013.01); *C11D 7/266* (2013.01); *C11D 11/0023* (2013.01)

(58) Field of Classification Search

None

See application file for complete search history.

(56) References Cited

U.S. PATENT DOCUMENTS

| | | | | |
|---|---|---|---|---|
| 2,275,660 | A | 3/1942 | Steinle et al. | |
| 2,598,666 | A | 6/1952 | Sesso et al. | |
| 3,395,028 | A | 7/1968 | Mackles | |
| 3,745,033 | A | 7/1973 | Hutchison | |
| RE27,890 | E | 1/1974 | Holbus | |
| 3,814,710 | A * | 6/1974 | Duncan | C08L 83/04 106/10 |
| 4,592,934 | A | 6/1986 | Wolstoncroft | |
| 7,598,216 | B2 | 10/2009 | Schultz et al. | |
| 8,349,062 | B2 | 1/2013 | Dunning et al. | |
| 2010/0150850 | A1 | 6/2010 | Tamor et al. | |

* cited by examiner

*Primary Examiner* — Lorna Douyon

(74) *Attorney, Agent, or Firm* — William G. Sykes

(57) ABSTRACT

A method of making a liquid or semi-liquid emulsion cleaning, waxing, and restoring product with applicability to painted motor vehicles. The emulsion removes bugs, tar and paint from other vehicles, etc. and is safe for paint, plastic, chrome and wheels. The emulsion is prepared using a unique sequence of mixing steps that result in a complete emulsification of ingredients that heretofore have been difficult or impossible to effectively combine. The emulsion may be provided in liquid or paste form or in microfiber cloths, or disposable towelettes, and other such carriers infused with the emulsion. The carrier is moistened with the emulsion and packaged in sealed individual packages. In other embodiments, multiple emulsion-soaked towels or towelettes may be packaged in reclosable cylinders from which individual towels may be extracted and the cylinder reclosed. These pre-soaked towelettes may be used to easily clean and wax vehicles or other similar surfaces.

6 Claims, 2 Drawing Sheets

CLEANING, POLISHING, AND RESTORING EMULSION AND METHOD OF MAKING AND PACKAGING THE EMULSION

RELATED APPLICATIONS

This application claims priority in accordance with 37 C.F.R. ¶1.19(e) to U.S. Provisional Patent Application Ser. No. 61/902,185 for Money Shine Solution and Pre-Packaged Kit filed Nov. 9, 2013 which is included herein in its entirety by reference.

FIELD OF THE INVENTION

The invention pertains to cleaning, waxing, and restoring solutions and, more particularly, to an emulsified liquid cleaning, polishing, and restoring solution having particular applicability to painted motor vehicles and a method of making the solution.

BACKGROUND OF THE INVENTION

Compositions for both cleaning and waxing painted surfaces, for example, the body of a car or other motor vehicle or the like are known and widely used. However, compositions of the prior art are not believed to have been formulated with optimum ingredients, or with ingredients in optimum ratios by weight. Typically that processes for combining ingredients in more optimum ratios have heretofore been unavailable. Further, compositions that clean, wax, and preserve such painted surface are highly desirable but are typically unavailable or ineffectual.

Currently, removal of various soils (e.g., dirt, dust, tar, and insect residues) and surface scratches from painted surfaces, such as automotive exterior surfaces, typically requires sequential application of several cleaning and polishing products. For example, liquid detergents are commonly used to wash the exterior surface of vehicles such as automobiles. Frequently, such exterior surfaces include stains from road tar or insect residue, which may not be adequately removed by common detergent products. Specialized "bug and tar" removing compositions are sold to remove such stains. The tar and bug removal products are typically used before washing the surface of the automobile, since residues from those removal products must be removed after their use.

Solid clay-based abrasive products, commonly referred to as "clay bars" may be used to remove surface contaminants from painted surfaces, such as automotive exterior surfaces. After the surface has been rubbed with the clay bar and a lubricant, the surface must then be washed or polished to remove the clay residue. Additionally, scratch and swirl removing compositions may be needed to remove paint finish abrasions in order to restore paint finish clarity, especially on scratch sensitive paint finishes or weathered surfaces prior to application of car wax or polish. Thus, cleaning a painted surface and removing surface scratches from the surface often involves multiple products and steps.

Because of the many types of cleaning and polishing products that typically must be used to clean a soiled automotive surface, it would, therefore, be advantageous to provide a convenient unitary product, which can clean a painted surface that includes dirt and dust, as well as tar and/or insect residue, and which also can ameliorate surface scratches

DISCUSSION OF THE RELATED ART

Several attempts to provide both a composition and/or a method of manufacturing such a product are found in the prior art. For example U.S. Pat. No. 2,275,660 for VEGETABLE WAX issued Mar. 10, 1942 to John Vernon Steinle et al, provides a wax composition that includes carnauba wax, mineral oil, and water.

U.S. Pat. No. 2,598,666 for WAX COMPOSITION issued Jun. 3, 1952 to Louis M. Sesso et al. teaches an aqueous wax composition containing carnauba wax, paraffin wax, and water.

U.S. Pat. No. 3,395,028 for WAX COMPOSITION AND METHOD FOR MAKING THE SAME issued Jul. 30, 1968 to Leonard Mackles provides a wax composition that includes carnauba wax, a water-in-oil emulsion, and a volatile solvent.

U.S. Pat. No. 3,745,033 for USEFUL WAX COMPOSITIONS issued Jul. 10, 1973 to Robert B. Hutchison provides a variety of wax compositions.

U.S. Pat. No. RE 27,890 for PROTECTIVE COATING FOR METAL SURFACES issued Jan. 15, 1974 to Edward Holbus discloses a wax composition containing carnauba wax, mineral oil, and water.

U.S. Pat. No. 4,592,934 for METHOD OF PREPARING AND PACKAGING AUTOMOBILE WAX issued Jun. 3, 1986 to Richard L. Wolstoncroft teaches multi-phase paste and liquid polish compositions having improved gloss life and water resistance durability are obtained by providing an oil external emulsion phase containing aminofunctional polysiloxane, and a water external emulsion phase containing dimethyl polysiloxane.

U.S. Pat. No. 7,598,216 for THREE-PHASE LIQUID POLISHING AND CLEANING COMPOSITION issued Oct. 6, 2009 to Michael A. Schultz et al. teaches a wax composition lacking carnauba wax but including mineral spirits. This composition is intended to both clean and polish.

U.S. Pat. No. 8,349,062 for COMPOSITION FOR WASHING AND WAXING A MOTOR VEHICLE issued Jan. 8, 2013 to Brent R. Dunning et al. discloses a composition for removing dirt from the body of a vehicle and containing carnauba wax and, optionally, mineral oil solvent.

None of the patents and published patent applications, taken singly, or in any combination are seen to teach or suggest the Cleaning, Polishing, and Restoring Emulsion and Method of Making Same of the present invention.

SUMMARY OF THE INVENTION

In accordance with the present invention there is provided a liquid or semi-liquid emulsion that leaves a deep luster shine on the surface of a painted motor vehicle or the like. The emulsion removes bugs, tar and paint transferred from other vehicles, and other similar materials. The novel emulsion is safe for use on plastic and cleans and shines chrome and chrome plated pieces. The emulsion cleans and shines and helps break up embedded dirt on wheels.

The emulsion is prepared using a unique sequence of mixing steps that result in a complete emulsification of ingredients that heretofore have been difficult or impossible to effectively combine.

The novel emulsion may be provided in liquid or paste form or in microfiber rags, cloths, shop clothes, disposable towelettes, and other such carriers infused with the novel emulsion. The carrier is saturated with the novel emulsion of the invention and packaged in sealed individual packages. In other embodiments, multiple emulsion-soaked towels may be packaged in reclosable cylinders from which individual towels may be extracted for use and the cylinder reclosed.

These pre-soaked towelettes or similar carriers may be used by the general public to easily clean and wax their vehicles or other similar surfaces.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
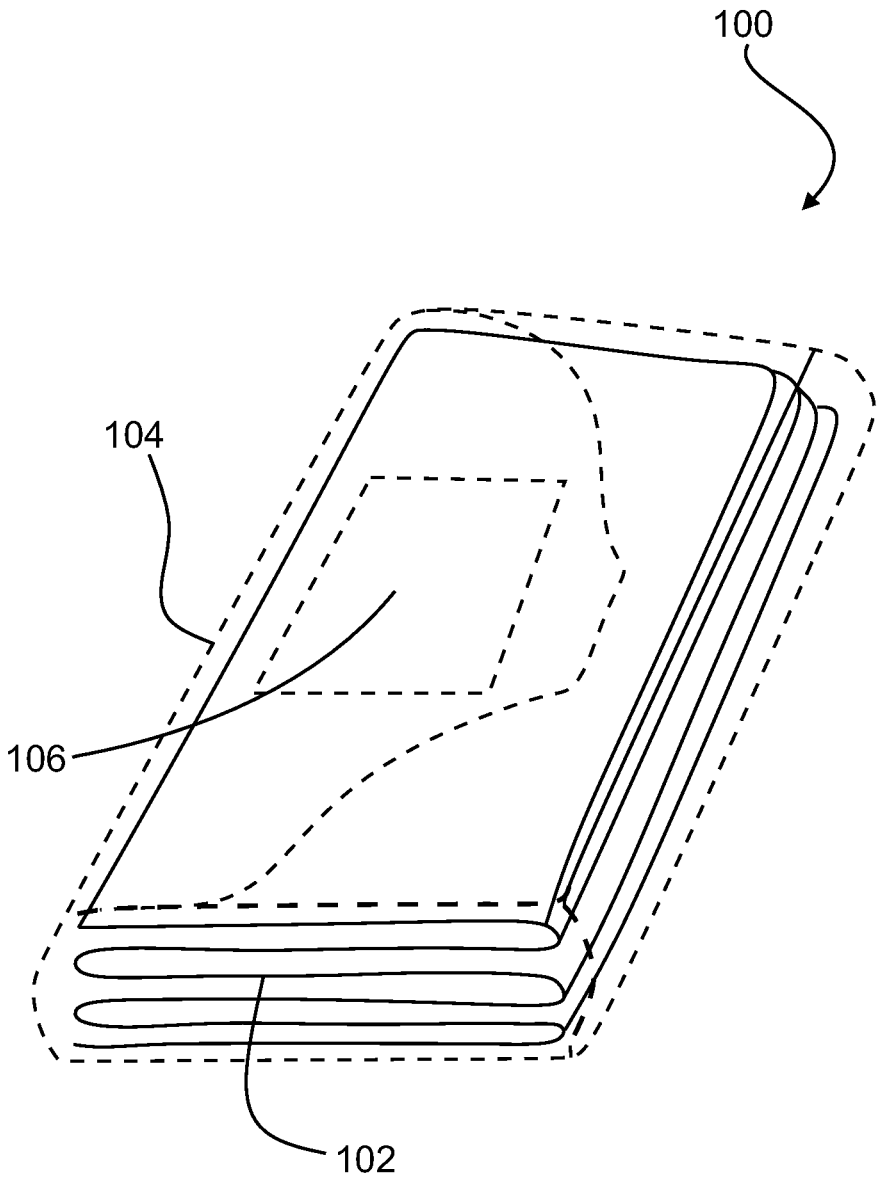
FIG. 1 is a perspective, schematic view of a package containing a cloth carrying the novel cleaning, polishing, and restoring emulsion in accordance with the invention.

The present invention provides a cleaning, polishing, and finish restoring emulsion and method of making the novel emulsion.

The cleaning, polishing, and finish restoring emulsion (CPR emulsion) in accordance with the invention is a combination of well-known ingredients. While the properties of each ingredient are believed to be known to those of skill in the art, there has never heretofore been a cleaning, polishing, restoring material formed therefrom as combining them has presented many obstacles.

The Applicant has discovered and perfected a unique process whereby these ingredients may be effectively combined (e.g., emulsified) into a practical CPR material, notably an emulsion.

The ingredients of the CPR emulsion include Water, Mineral Spirits, and Carnauba Wax.

Mineral spirits are a mixture of aliphatic and alicyclic C7 to C12 hydrocarbons with a maximum content of 25% of CI to C12 aromatic hydrocarbons. A typical composition for mineral spirits is >65% CIO or higher hydrocarbons,—aliphatic solvent hexane, and a maximum benzene content of 0.1% by volume, a kauri-butanol value of 29, an initial boiling point of 65° C. (149° F.), a dry point of approximately 69° C. (156° F.), and a density of 0.79 g/ml. Stoddard solvent, also known as "white spirit" is a specific mixture of hydrocarbons, typically >65% CIO or higher hydrocarbons.

Liquid carnauba wax consists of fatty acid esters (80-85%), fatty alcohols (10-16%), acids (3-6%) and hydrocarbons (1-3%). It is around 20% esterified fatty diols, 10% methoxylated or hydroxylated cinnamic acid, and 6% hydroxylated fatty acids. Carnauba wax has a very high melting point of 82-86° C. (180-187° F.). It is harder than concrete and nearly insoluble in water and ethanol. It is non-toxic and hypoallergenic. The combination of properties leads to many applications, including use in food, cosmetics, automobile and furniture wax, molds for semiconductor devices, and as a coating for dental floss. Carnauba wax is one of those extremely useful natural chemicals and renewable resources that does not have a synthetic equivalent.

As carnauba wax is insoluble in water, combining liquid carnauba wax with water is, therefore, problematic. However, when mixed together in a certain novel sequence, a stable emulsion of water, mineral spirits, and carnauba wax may be formed.

First, mineral spirits is added to liquid carnauba wax in a ratio of approximately 0.85 to 1 mineral spirits to wax by volume.

The liquid carnauba wax and mineral spirits are then shaken vigorously for a period of approximately three minutes. It will be recognized by those of skill in the art that the shaking time may be shorter or longer depending upon the intensity of the agitation (i.e., shaking).

When the shaking is complete, the shaken carnauba wax/mineral spirits is allowed to settle for approximately five minutes, and then the shaking is continued. The shaking/resting cycle is repeated until the carnauba wax/mineral spirits has emulsified. Emulsification has occurred when the ingredients are combined into a uniform pourable paste that shows no visible separation of the components. In addition, when hand-agitated, at the point of emulsification, the ingredients will discernibly change in both apparent viscosity/texture and in the "feel" experienced by the agitator as the mixture reaches a denser state. The typical number of cycles is typically in the range of between two and five cycles.

A first additional 0.85 by volume of mineral spirits (i.e., a ratio of 0.85 to 1 of mineral spirits to liquid carnauba wax) is added and the shaking resumed and continued until the ingredients have again emulsified. The time depends on several environmental factors and is typically between approximately two and five minutes.

Then a second additional 0.85 by volume of mineral spirits is added and again shaking is resumed and continued until the ingredients have again emulsified. This time also depends on several environmental factors and is typically between approximately two and five minutes.

Finally, approximately 0.7 by volume of water is added to the mixtures and shaking again resumed to emulsify the water with the emulsified carnauba wax and mineral spirits. The shaking time is typically between approximately two and five minutes.

Once the final emulsification has occurred, the CPR emulsion is complete and ready for use.

It will be recognized by those of skill in the art that mechanical agitation may be substituted for the manual shaking chosen for purposes of discloser. It will be further recognized that shaking times may be commensurate with the agitation force used.

While the CPR emulsion in accordance with the invention may be packaged in any conventional package suitable for liquids, it may also be packaged in a potentially more convenient manner.

A rag, towel, cloth, preferably a microfiber cloth, or paper towelette may be fully or partially saturated with the CPR emulsion and then packaged in individual sealed packages or multiple rags, towels, cloths, or paper towelettes may be packaged together in a dispensing container.

Referring now to FIG. 1, there is shown a perspective, schematic view of a package containing a single cloth carrying the novel CPR emulsion, generally at reference number 100. A cloth 102, preferably formed from a microfiber material and being wetted (i.e., moistened, saturated, etc.) with the novel CPR emulsion, not specifically identified, is folded and placed in a sealed package, bag, or envelope 104. It will be recognized that the degree of wetting may be controlled and selected to meet the requirements of a particular operating environment or circumstance. Package 104 is typically formed from transparent material impervious to the novel CPR emulsion. Such packages are believed to be well known to those of skill in the art and, consequently, are neither further described or discussed herein. Any suitable package shape and/or suitable material may be used to contain and store cloth 102.

A label 106 may be affixed to the package to identify the package contents and provide any material information related to the novel CPR emulsion required by law.

It is anticipated that a package 104 would typically contain a single cloth 102. However, it will be recognized that it is possible to package more than one cloth 102 in package 104. Consequently, the invention is not considered limited to the number of cloths 102 packaged in package 104.

Figure 2:
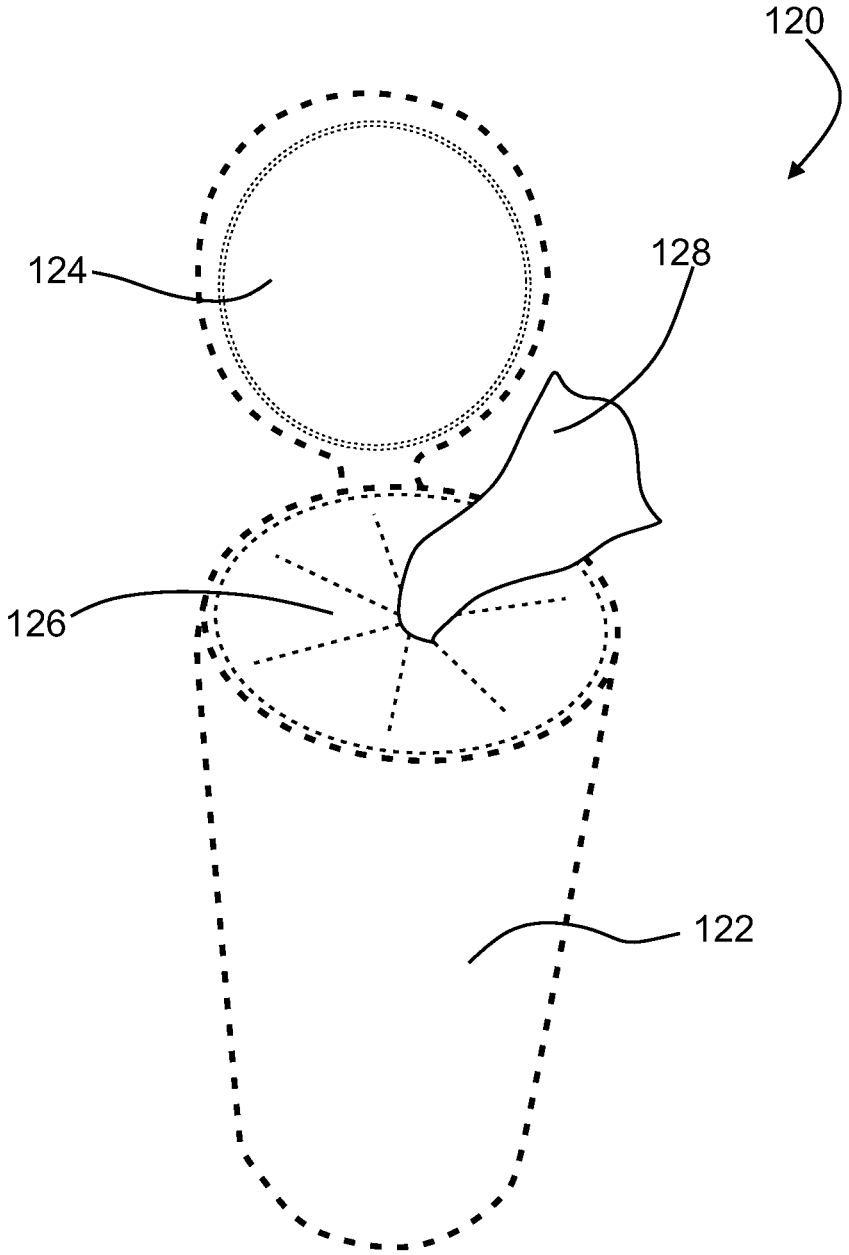
FIG. 2 is a perspective, schematic view of a container housing a plurality of cloths or towelettes carrying the CPR emulsion.

Referring now also to FIG. 2, there is shown a perspective, schematic view of a recloseable container housing a plurality of cloths or towelettes moistened with the novel CPR emulsion in accordance with the invention, generally at reference number 120. Such dispensing containers are believed to be well known for dispensing wetted towelettes for other cleaning products.

A typical multi-towelette dispensing package is a cylinder 122 having a resealable top 124. A separating/singulating device 126 is usually placed at the top of the cylinder 122 but inside the resealable top 124. The singulating device allows easy removal of the moistened/saturated towelettes 128 one-at-a-time as they are needed.

A label 130 may be affixed to an external surface of cylinder 122. Label 130 may contain product identification information, the quantity of towelettes, and any material information related to the novel CPR emulsion required by law.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

What is claimed is:

1. A method for emulsifying an admixture comprising carnauba wax, mineral spirits, and water, the steps comprising:

a) in a closeable container, adding mineral spirits to liquid carnauba wax in a ratio of approximately 0.85 to 1 of mineral spirits to liquid carnauba wax;

b) closing said closable container and shaking said liquid carnauba wax and said mineral spirits;

c) after said shaking step (b), allowing said liquid carnauba wax and said mineral spirits to rest;

d) repeating said shaking step (b) and said resting step (c) until after said shaking step (b), said liquid carnauba wax and said mineral spirits have emulsified;

e) after said repeating step (d), adding additional mineral spirits in 0.85 to 1 ratio of mineral spirits to liquid carnauba wax by volume;

f) again shaking said emulsified liquid carnauba wax and mineral spirits with said newly added mineral spirits until emulsified;

g) after said shaking step (f), adding additional mineral spirits in approximately a 0.85 to 1 ratio of mineral spirits to liquid carnauba wax by volume;

h) again shaking said emulsified liquid carnauba wax and mineral spirits with said newly added mineral spirits until emulsified;

i) adding water to said emulsified liquefied carnauba wax and mineral spirits, adding water in a ratio of approximately 0.7 to 1 water to carnauba wax by volume; and j) shaking the emulsified carnauba wax and mineral spirits with said added water until a completely emulsified admixture is produced.

2. The method for emulsifying an admixture comprising carnauba wax, mineral spirits, and water as recited in claim 1, wherein said shaking step (b) is performed for approximately three minutes.

3. The method for emulsifying an admixture comprising carnauba wax, mineral spirits, and water as recited in claim 1, wherein said resting step (c) is performed for approximately five minutes.

4. The method for emulsifying an admixture comprising carnauba wax, mineral spirits, and water as recited in claim 1, wherein said repeating step (d) is performed between approximately two and five times.

5. The method for emulsifying an admixture comprising carnauba wax, mineral spirits, and water as recited in claim 1, wherein each of said shaking steps (f), (h), and (j) are performed for a time in the range of approximately two to five minutes.

6. The method for emulsifying an admixture comprising carnauba wax, mineral spirits, and water as recited in claim 1, wherein at least one of said shaking steps (f), (h), and (j) are performed for a time in the range of approximately two to five minutes.

* * * * *